United States Patent [19]

Sachleben et al.

[11] Patent Number: 4,541,576

[45] Date of Patent: Sep. 17, 1985

[54] AUTOMATIC TAIL FORMING APPARATUS AND METHOD

[75] Inventors: Harold G. Sachleben, Bellmawr, N.J.; David W. Hubbard, Richmond, Va.; Richard A. Botset, Chester, Va.; Thomas B. Hardage, Richmond, Va.

[73] Assignee: Allied Corporation, Morris Township, Morris County, N.J.

[21] Appl. No.: 483,311

[22] Filed: Apr. 8, 1983

[51] Int. Cl.[4] ..... B65H 54/02

[52] U.S. Cl. ..... 242/18 PW

[58] Field of Search ..... 242/18 PW, 18 R, 43 R, 242/18 A

[56] References Cited

U.S. PATENT DOCUMENTS

| | | | |
|---|---|---|---|
| 3,933,319 | 1/1976 | Sachleben, Sr. et al. | 242/18 R |
| 3,964,722 | 6/1976 | Boggs et al. | 242/18 PW |
| 4,111,375 | 9/1978 | Dolle | 242/18 PW |
| 4,359,858 | 11/1982 | Wolf | 57/93 |

*Primary Examiner*—Stanley N. Gilreath

*Attorney, Agent, or Firm*—Virginia S. Andrews; William H. Thrower

[57] ABSTRACT

Method and apparatus for starting a running length of yarn to wind at a given point on a rotating bobbin during yarn stringup of a bobbin winder with a thrustable tail forming stringup aid are provided. The method features actuating a sensor to sense the presence of a moving yarn guide to operate a solenoid for thrusting a stringup aid to an operative, tail forming position, thereby causing the yarn to start winding on the bobbin at the desired given point. The apparatus comprises a sensor, actuated by the moving yarn guide, and a solenoid, operated by the actuated sensor to thrust a stringup aid into operative position. The method and apparatus ensure consistent formation of good transfer tails.

3 Claims, 3 Drawing Figures

AUTOMATIC TAIL FORMING APPARATUS AND METHOD

BACKGROUND OF THE INVENTION

2. Field of the Invention

This invention relates to winding yarn, more particularly to an apparatus and method for starting a running length of yarn to wind, preferably a transfer tail, at the same point on each bobbin during initial yarn stringup on a bobbin winder, preferably on a vertical spindle winder.

2. The Prior Art

This invention is particularly adapted for use in conjunction with the improved vertical spindle winder and transfer tail apparatus and method disclosed in, respectively, U.S. Pat. Nos. 3,933,319 to Sachleben, Sr. et al. and 3,964,722 to Boggs et al., both of which are hereby incorporated by reference.

Yarn transfer tails function to connect yarn packages for their use in series without interruption in a process. This is accomplished by knotting the transfer tail at the end of one package to the beginning end of the next package, serially. The transfer tail should be equivalent in quality and strength to other yarn on the bobbin; therefore, yarn initially wrapped on the barrel of the bobbin is preferably used as the transfer tail. Availability of the transfer tail can only be assured by starting the initial yarn wrap at the same point on the bobbin, preferably its base, for all yarn packages.

In U.S. Pat. No. 3,964,722 to Boggs et al., actuation of the transfer tail apparatus occurs when the operator steps on lever 5 (see FIG. 2 of Boggs et al.). With reference to FIG. 4 of U.S. Pat. No. 3,933,319 to Sachleben, Sr. et al., the initial yarn-to-bobbin contact will depend on the position of lower yarn guide wheel 43 when lever 5 is depressed. It is preferred that the wheel be located at the bottom of its traverse when the transfer tail apparatus is actuated; since actuation is discretionary with the operator, however, this seldom occurs on a consistent basis. The present invention was devised to overcome these problems.

U.S. Pat. No. 3,964,722 to Boggs et al. discloses that the stringup aid can be thrust outwardly by a solenoid. U.S. Pat. No. 4,111,375 discloses the use of the yarn traverse guide position to trigger movement of a pivoting rod for forming a transfer tail.

SUMMARY OF THE INVENTION

The present invention provides a method and apparatus for starting a running length of yarn to wind at a given point on a rotating bobbin during yarn stringup of a bobbin winder with a thrustable tail forming stringup aid.

The method comprises actuating a sensor to sense the presence of a moving yarn guide to operate a solenoid for thrusting a stringup aid to an operative tail forming position, thereby causing the yarn to start winding on the bobbin at the desired point. It is preferred that the solenoid be operated by a relay actuated by the sensor. The thrustable stringup aid preferably is previously thrusted up while the bobbin is stationary. A prior step of energizing the solenoid to bring the stringup aid into an inoperative position occurs substantially simultaneously with the step of actuating the sensor and starting rotation of the bobbin. The relay subsequently de-energizes the solenoid for the thrusting step so that winding begins adjacent to the bobbin flange.

In the apparatus, the bobbin winder comprises a moving yarn guide whose location determines the starting point of the yarn winding on the bobbin. The apparatus comprises a sensor, actuated by the moving yarn guide, and a solenoid, operated by the actuated sensor to thrust a stringup aid into operative position. The preferred sensor is a proximity sensor although photo sensors or mechanical sensors (limit switch) could readily be used. It is also preferred that the apparatus additionally comprise a relay actuated by the sensor to operate the solenoid. It is also preferred that the moving yarn guide be a compensating pulley and that the solenoid be a rotary solenoid which is de-energized by the actuated relay. The thrustable stringup aid preferably comprises a slotted plate into the slot of which extends an actuating pin which is connected to an eccentric hub which is connected to and turned by the solenoid. Turning of the solenoid causes the actuating pin to move the slotted plate in a transverse direction for actuating of the stringup aid to an operating position.

The method and apparatus of this invention have been used successfully to form good transfer tails and to prevent stringups having no tails or bad tails. It has been particularly successful with forming good, unstretched tails when winding undrawn yarn.

DESCRIPTION OF THE PREFERRED EMBODIMENT

Figure 1:
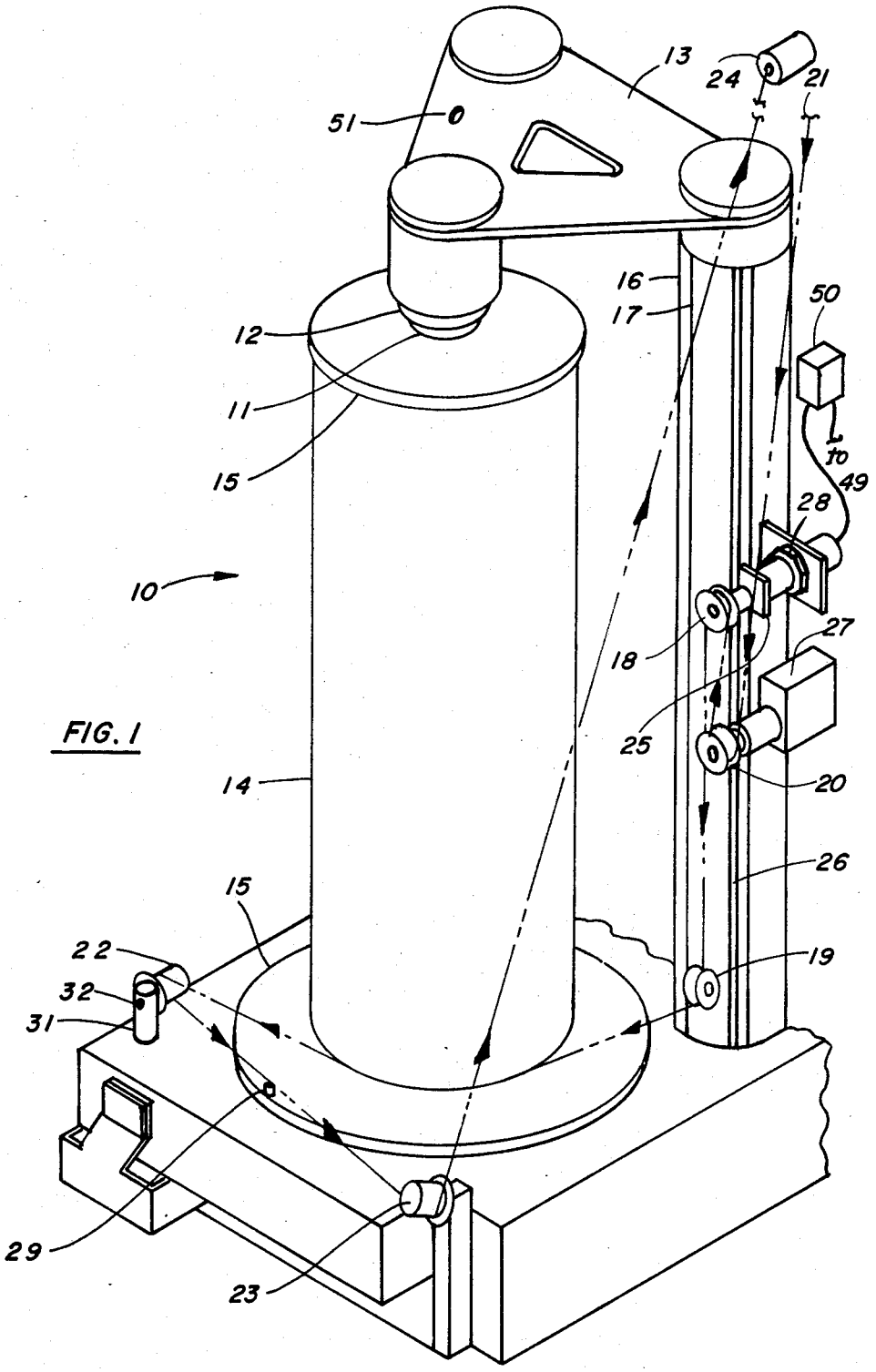
FIG. 1 is an isometric view showing the vertical spindle winder, traverse mechanism, and tail forming apparatus.

The preferred embodiment is shown in the drawings and will be described below. For greater detail on the winder reference may be had to U.S. Pat. No. 3,933,319 to Sachleben, Sr. et al.

Vertical spindle 10 is mounted on stub shaft at the bottom (unshown) and in the spindle engaging receiver 11 at the top. It rotates on bearings below (unshown) and above in bearing housing 12 and is held in place by spindle mounting bracket 13. Vertical spindle 10 is made up of bobbin (or hub) 14 and flanges 15. Cam 16 and cam housing 17 are shown in position vertically along the length of vertical spindle 10. The presser roll, which presses upon the yarn package as it is being wound to maintain it cylindrical and compact, has been omitted for clarity. Cam 16 is driven by a shaft connected to a traverse pulley (unshown). Cam 16 is a double track cam which drives both upper yarn guide wheel 18 (a compensating pulley) and lower yarn guide wheel 19. The downcoming yarn, shown by the arrows in the figure, first passes under stationary yarn guide wheel 20, then over upper vertically moveable yarn guide wheel 18, then under lower vertically moveable yarn guide wheel 19 and across the inner face of bobbin flange 15 and around spool 22, which forms part of the thrustable string up aid 30 and tail forming apparatus, and across the outer face of lower bobbin flange 15 to pass around spool 23 to aspirator 24. Upper yarn guide wheel 18 is connected by means of a bracket to a slot follower (both unshown) which oscillates in slot 26 in cam housing 17. Stationary yarn guide wheel 20 is mounted in pin support 27. Lower yarn guide wheel 19 is mounted on a bracket which is in turn attached by means of a bolt to a plate which hides the lower slot follower (all unshown). The two vertical oscillating yarn wheel guides 18 and 19 are driven by the double track cam in such a manner that the upper yarn wheel guide 18 operates in the upper half of the slot 26 and the lower yarn wheel guide 19 operates across nearly the full length of slot 26. The upper yarn wheel guide 18 moves at one-half speed of the full traverse yarn wheel guide 19. Acting in concert, these wheels maintain a constant length of yarn between stationary yarn wheel guide 20 and the point where the yarn contacts spindle 10 as it is being wound. More detail may be found in U.S. Pat. No. 3,933,319 to Sachleben, Sr. et al.

In the prior art, the operator strung up and then depressed button 51 to start the winder drive mechanism; the bobbin flange 15, with pin 29 attached underneath and near its outer edge, attained the desired speed. The spring loaded string up aid was then manually released as described in U.S. Pat. No. 3,964,722 to Boggs et al. Essentially, the stringup aid described in the Boggs et al. patent with spring plunger 31 and attached spool 22 sprang upward to bring the yarn being aspirated to a position where the rotating bobbin pin 29 engaged the yarn. At this point, the yarn in the aspirator was reversed in direction and tension was applied to the yarn across an internal cutter (unshown) in aspirator 24 which cut the yarn. Activation of the stringup aid was discretionary with the operator, making the point of initial yarn winding on the the bobbin 14 variable.

As can be seen by reference to FIG. 1, the location of lower yarn guide wheel 19 will determine the point at which yarn starts wrapping on the hub or bobbin 14 of spindle 10. When yarn 21 initially wraps on bobbin 14, preferably at the base adjacent lower flange 15, bobbin 14 is rotating at a speed which is slower than normal winding speed. After a suitable time delay, rotation automatically accelerates to a higher, winding speed. This normally occurs before yarn 21 has an opportunity to form an initial wrap on bobbin 14 in its entirety. Subsequent wraps at the higher winding speed turn at the reversal so quickly that approximately the first 1.9 cm (0.75 inch) lay of yarn 21 on bobbin 14 adjacent flange 15 is not covered by ensuing layers of yarn until the package is substantially larger. This portion of the yarn package provides a high quality transfer tail. However, this is dependent on lower yarn guide wheel 19 being at the bottom of its traverse when yarn 21 starts wrapping on bobbin 14.

Figure 2:
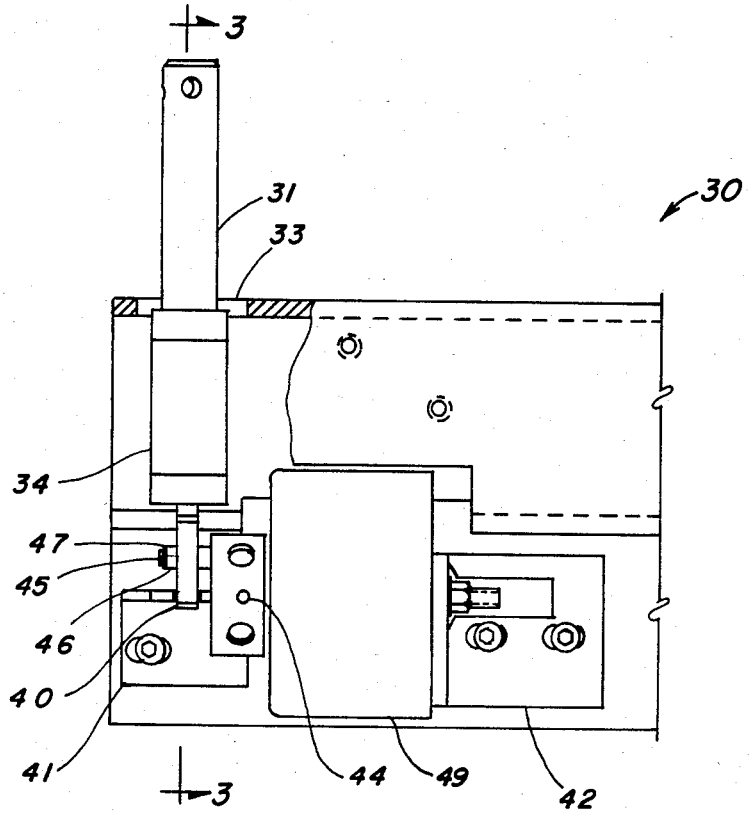
FIG. 2 depicts the tail forming apparatus of the present invention without its cover.
Figure 3:
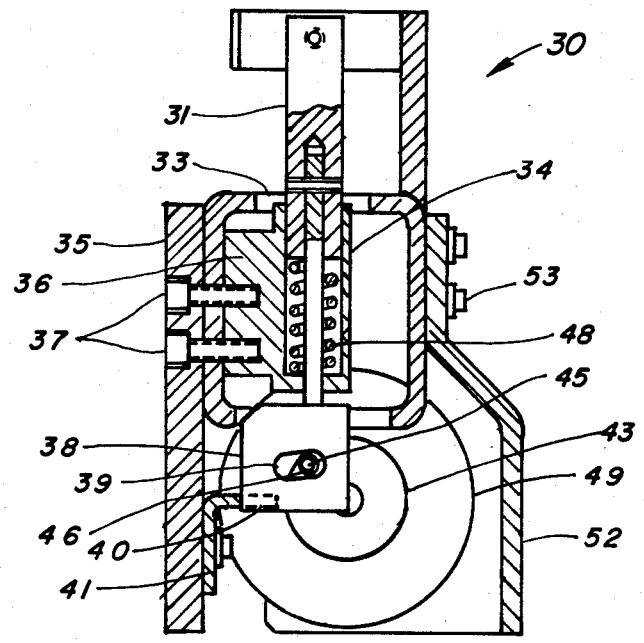
FIG. 3 is a sectional view taken on line 3—3 of FIG. 2.

The present invention, devised to eliminate operator discretion when yarn 21 starts wrapping on bobbin 14, will now be described. Proximity sensor 28 (tubular type Model No. ES7MAL18A2, available from Cutler-Hammer Products Division of Eaton Corporation) is mounted to a bracket (unshown) on the side of cam housing 17. The sensor 28 is a Hall-effect device which senses the presence of metal within a range of about 0.63 cm (0.25 inch) to cause a switching output. Relay 50 is actuated by sensor 28 when actuating plate 25, welded to upper yarn guide wheel 18 mounting bracket, is traversed into range. Relay 50 operates (de-energizes) rotary solenoid 49 (see FIGS. 2 and 3) and spring 48 thrusts stringup aid 30 to an operative, tail forming position.

Spool 22 is connected to plunger 31 by shaft 32 transversely and rigidly. Plunger 31 passes through slot 33 to housing 34. Housing 34 is rigidly attached to winder member 35 by means of screws 37 to projection 36. The base of plunger 31 is a plate 38 with slot 39 therein. Plate 38 is guided by slot 40 in guide bracket 41. Bracket 42 holds rotary solenoid 49 (Ledex Model No. S-8217-026). Eccentric hub 43 is pinned to solenoid 49 by spirol pin 44. Eccentric hub 43 has actuating pin 45 attached thereto and extending through slot 39. Actuating pin 45 supports bearing 46 which is held in place by retainer ring 47. Pin 45 and bearing 46 move plunger 31 downward, against the force of compression spring 48, when rotary solenoid 49 is energized. The normal position of plunger 31 is up, held in position by spring 48. Solenoid shield 52 is held in place by screws 53.

In operation, the operator mounts an empty spindle 10 on the stub shaft and pulls the spindle mounting bracket 13 (with associated bearing housing 12 and spindle engaging receiver 11) into place. Plunger 31 with associated spool 22 is up. The operator then strings up the system as previously described. After stringup, the operator pushes button 51 which (1) starts the drive mechanism for the winder, (2) activates sensor 28 which is wired into the existing drive mechanism circuit, and (3) energizes solenoid 49 to cause plunger 31 with associated spool 22 to go down. The turning of solenoid 49 turns hub 43 and thus pin 45 and bearing 46 down against the base of slot 39 to pull plate 38 and plunger 31 connected thereto down against the force of spring 48. As cam 16 turns within its housing 17, upper 18 and lower 19 yarn guide wheels are traversed through their cycles. When upper yarn guide wheel 18 with actuation plate 25 passes sensor 28, sensor 28 actuates relay 50 which de-energizes rotary solenoid 49. Wheel 19 is then at the bottom of its traverse near bobbin flange 15. Compression spring 48 then thrusts plunger 31 with associated spool 22 up which lifts yarn 21 so that pin 29 of bobbin flange 15 pulls yarn 21 against the force of aspirator 24 to cut the yarn with an internal cutter (unshown). The portion of yarn between spool 22 and aspirator 24 cutter wraps beneath bobbin flange 15 during winding. The initial wrap of yarn on bobbin 14 therefore always starts when lower yarn guide wheel 19 is at its lowest traverse position to thereby ensure consistent formation of good transfer tails.

We claim:

1. In a method for starting a running length of yarn to wind at a given point on a flanged bobbin during yarn stringup of a vertical spindle winder so as to form a transfer tail of yarn, said winder comprising a flanged bobbin, a thrustable string-up aid, a pin at the outer edge of the outer face of the flange of said bobbin, and a vertically movable yarn guide which, during operation of said winder, oscillates for the full traverse of the winding yarn and determines the position of the yarn winding on the bobbin, said thrustable string-up aid being movable from an inoperative tail forming position to an operative tail forming position, said method comprising engaging said yarn with said movable yarn guide and said string-up aid in an inoperative tail forming position and, with said winder in operation, moving said string-up aid to an operative tail forming position, thereby bringing said yarn into contact with said pin to bring about winding of the yarn on the bobbin, the improvement comprising sensing the presence of said movable yarn guide at a predetermined location and moving said string-up aid to said operative tail forming position when said movable yarn guide is at said predetermined location, thereby causing said yarn to begin winding at said given point.

2. In a vertical spindle winder apparatus for winding a running length of yarn on a flanged bobbin and for forming a transfer tail comprising in combination a thrustable string-up aid movable from an inoperative tail forming position to an operative tail forming position, a pin at the outer edge of the outer face of the flange of said bobbin, and a vertically movable yarn guide which during operation oscillates for the full traverse of the winding yarn and determines the position of the yarn winding on the bobbin, the improvement comprising a. proximity sensor means to sense the presence of said movable yarn guide at a predetermined location, and b. actuating means to cause said thrustable stringup aid to move to an operative tail forming position in response to the presence of said movable yarn guide at said predetermined location, thereby placing said yarn in contact with said pin to bring about winding of the yarn at a given point on the flanged bobbin.

3. The apparatus of claim 2 wherein said thrustable stringup aid comprises a plunger having a slotted plate connected thereto, said actuating means comprises a rotary solenoid having an actuating pin connected thereto, said actuating pin extending into the slot of said slotted plate, whereby turning of the solenoid, in response to said sensor means, causes the actuating pin to move the slotted plate, thereby moving said stringup aid to the operative position.

* * * * *